US006409690B1

(12) United States Patent
Chen

(10) Patent No.: US 6,409,690 B1
(45) Date of Patent: Jun. 25, 2002

(54) MASSAGE DEVICE FOR FEET

(76) Inventor: Sherry Chen, P.O. Box 63-99, Taichung 406 (TW)

( * ) Notice: Subject to any disclaimer, the term of this patent is extended or adjusted under 35 U.S.C. 154(b) by 0 days.

(21) Appl. No.: 09/784,880

(22) Filed: Feb. 14, 2001

(51) Int. Cl.[7] ..... A61H 15/00
(52) U.S. Cl. ..... 601/126; 601/127; 601/128
(58) Field of Search ..... 601/28, 31, 32, 601/90, 93, 95, 112, 134

(56) References Cited

U.S. PATENT DOCUMENTS 2,168,842 A * 8/1939 Kesteven ..... 601/119
5,474,521 A * 12/1995 Yang ..... 601/126
5,711,758 A * 1/1998 Tseng ..... 601/126
6,162,150 A * 12/2000 Lee ..... 601/31

* cited by examiner

*Primary Examiner*—Michael A. Brown

(57) ABSTRACT

A massage device for massaging feet of user has a rotary member rotatably supported on a base and having a number of massage projections for massaging the feet of the user. A handle is supported above the base for supporting the upper portion of the user. The upper surface of the rotary member is preferably upwardly curved for increasing the massaging effect of the massage projections. The handle may be stored in the bottom of the base. A latch may be used to selectively lock the rotary member to the base for preventing the rotary member from rotating relative to the base.

15 Claims, 4 Drawing Sheets

MASSAGE DEVICE FOR FEET

BACKGROUND OF THE INVENTION

1. Field of the Invention

The present invention relates to a massage device, and more particularly to a massage device for massaging the feet of the users.

2. Description of the Prior Art

Typical massage devices for feet of the users comprise a square or rectangular base having a size for supporting the feet of the user only, and having a number of motorized projections slidably and movably received in the base for being moved upward and downward relative to the base and for massaging the feet of the users. The base has the size just enough to support the feet of the user, and is not allowed for the users to conduct such as the stepping exercises on the base. In addition, the base includes a flat upper surface such that the projections may not be effectively used to massage the feet of the users.

The present invention has arisen to mitigate and/or obviate the afore-described disadvantages of the conventional massage devices for feet of the users.

SUMMARY OF THE INVENTION

The primary objective of the present invention is to provide a massage device for massaging the feet of the users including a rotary member having a number of massage projections extended upward therefrom for massaging purposes.

The other objective of the present invention is to provide a massage device for massaging the feet of the users including a handle provided above the base for supporting the upper portion of the users.

In accordance with one aspect of the invention, there is provided a massage device for massaging feet of user, the massage device comprising a base including an upper portion, a rotary member rotatably supported on the upper portion of the base and including an upper portion having a plurality of massage projections extended upward therefrom for engaging with and for massaging the feet of the user, and a handle supported above the base for supporting an upper portion of the user. The users may step on the rotary member and may twist and exercise their waist portions. The massage projections of the rotary member may be used to massage the feet of the users.

The rotary member includes an upwardly curved upper surface provided on the upper portion thereof and having the massage projections extended upward therefrom for engaging with and for facilitating the massaging the feet of the user.

The base includes an outer peripheral portion having a plurality of massage projections extended upward therefrom for engaging with and for massaging the feet of the user.

A device is further provided for locking the rotary member to the base and includes a latch selectively engaged with the base and the rotary member for selectively locking the rotary member to the base and for preventing the rotary member from rotating relative to the base when required.

The base includes a lock slot formed therein for selectively receiving the latch, and the rotary member includes a lock notch formed therein for selectively receiving the latch. The base includes a storing slot formed therein and communicating with the lock slot of the base for selectively receiving and storing the latch.

A device is further provided for rotatably supporting the rotary member on the base and includes a plurality of balls engaged between the base and the rotary member. The base includes a plurality of cavities formed therein, and the rotary member includes a bottom portion having at least one circular groove formed therein for receiving the balls.

A device is further provided for supporting the handle above the base and includes at least one tube secured on the base, a rod slidably engaged in the tube, and means for adjustably securing the rod to the tube.

The base includes one or more recesses formed therein for receiving the tube and the rod, and the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
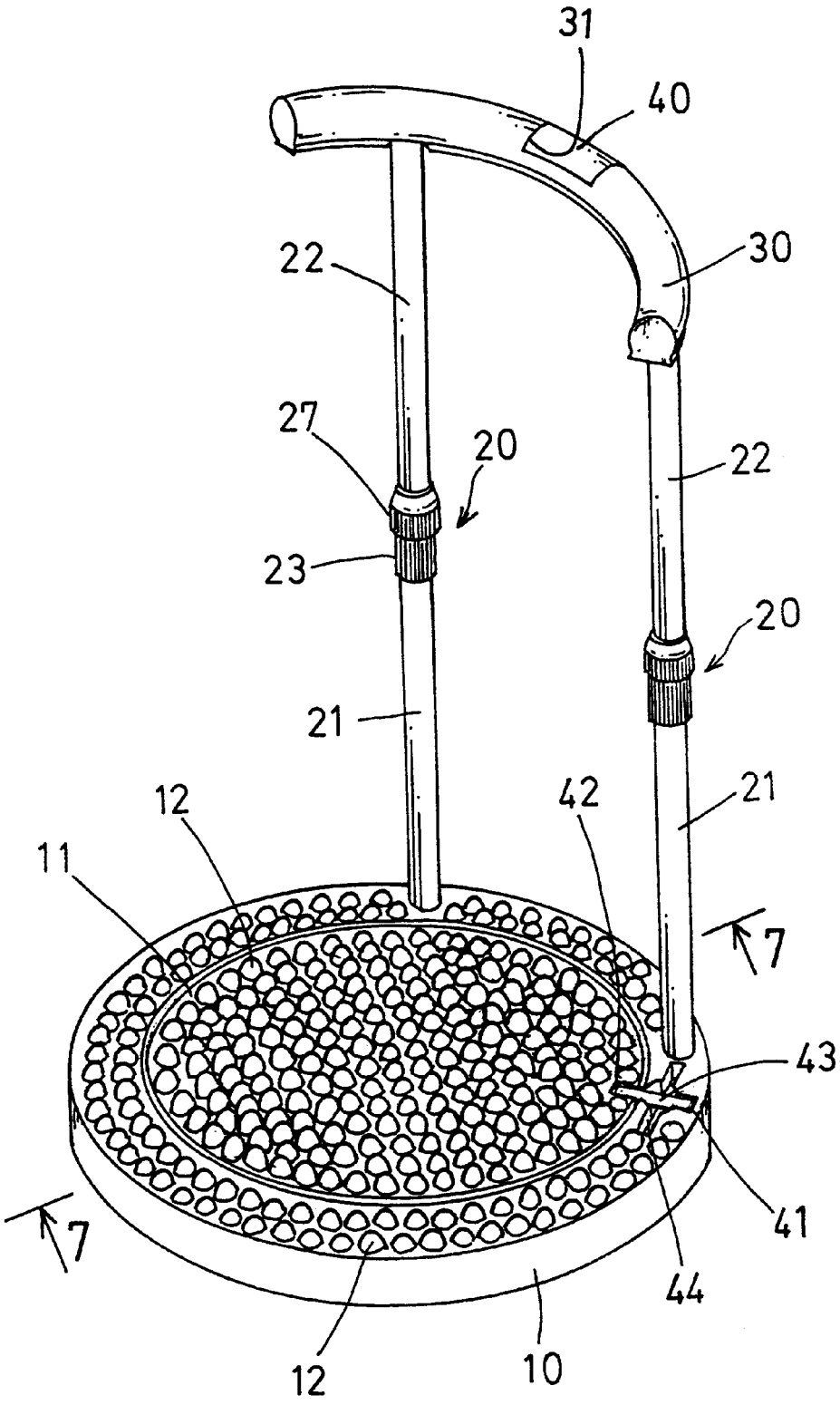
FIG. 1 is a perspective view of a massage device in accordance with the present invention.

Referring to the drawings, and initially to FIGS. 1 and 5–7, a massage device in accordance with the present invention comprises a base 10 including a recess 13 formed in the upper portion thereof for rotatably receiving a rotary member 11 therein. The rotary member 11 includes an upwardly curved bulge 111 (FIG. 7) extended or provided on top thereof and includes a number of rounded projections 12 extended upward from the upwardly curved bulge 111 for engaging with and for massaging the feet of the users. The base includes an outer peripheral portion having a number of rounded projections 12 extended upward therefrom for engaging with and for massaging the feet of the users. The base 10 includes a number of cavities 18 formed in the upper portion thereof and communicating with the recess 13 thereof for rotatably receiving balls 19 therein. The cavities 18 of the base 10 and the balls 19 are preferably arranged in one or more concentric circulars. The rotary member 11 includes one or more concentric circular grooves 15 formed in the bottom thereof for receiving the balls 19 (FIG. 7) and for facilitating the rotational movement of the rotary member 11 relative to the base 10.

Figure 2:
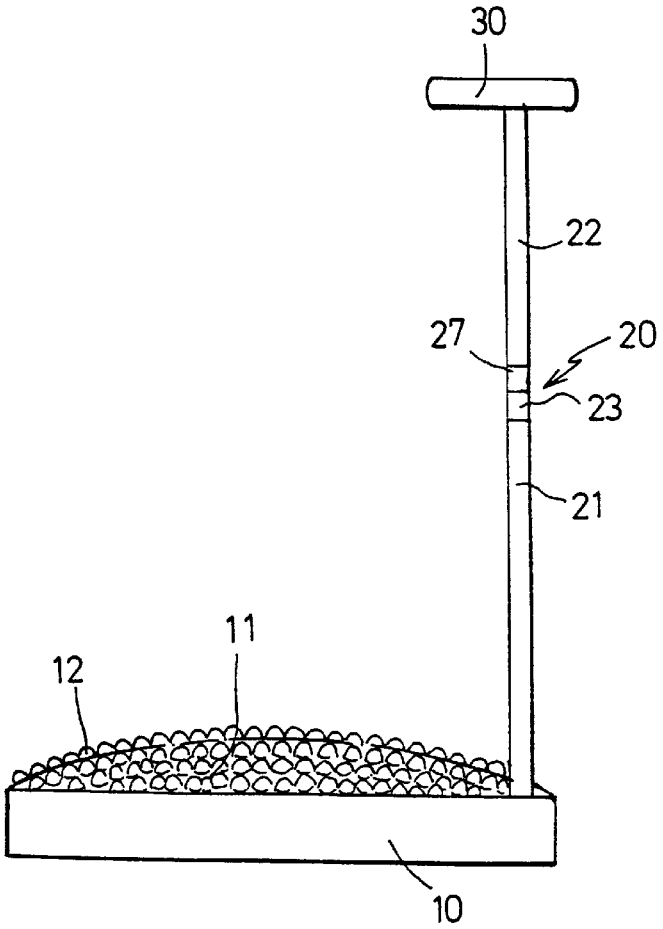
FIG. 2 is a side view of the massage device.
Figure 3:
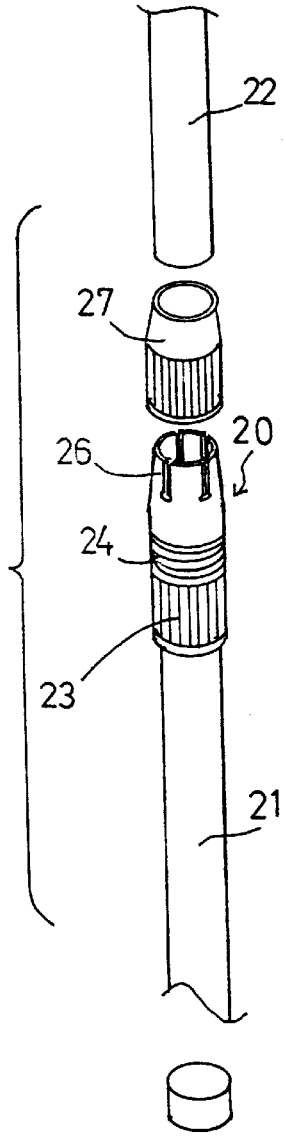
FIG. 3 is a partial exploded view of a support or an adjustable support for the massage device.

As shown in FIGS. 1–3; a handle 30 is disposed above the base 10 with one or more supports 20 for supporting the upper portion of the user. The supports 20 each includes a tube 21 secured on the base 10 with such as a force-fitted engagement or with an adhesive materials, or with fasteners etc., and includes a rod 22 slidably received in the tube 21. A barrel 23 is secured on top of the tube 21 and includes an outer thread 24 formed thereon and includes one or more spring blades 26 provided on top thereof for engaging with the rod 22. A control ferrule 27 is slidably and rotatably engaged on the rod 22 and threaded with the outer thread 24 of the barrel 23 for engaging with the spring blades 26 and for forcing the spring blades 26 to engage with the rod 22 and to secure the rod 22 to the tube 21.

Figure 4:
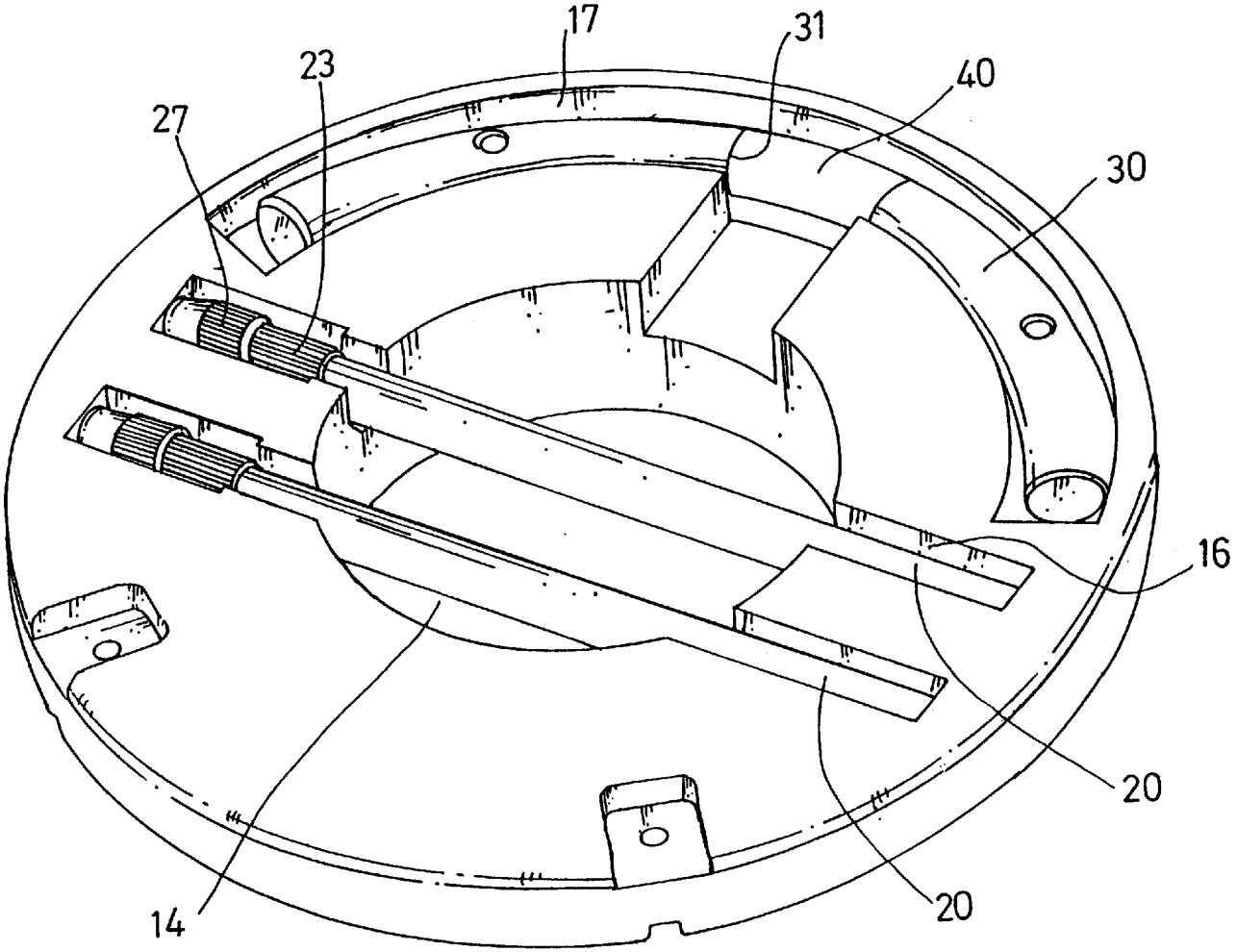
FIG. 4 is a bottom perspective view illustrating the folding or storing configuration of the massage device.
Figure 5:
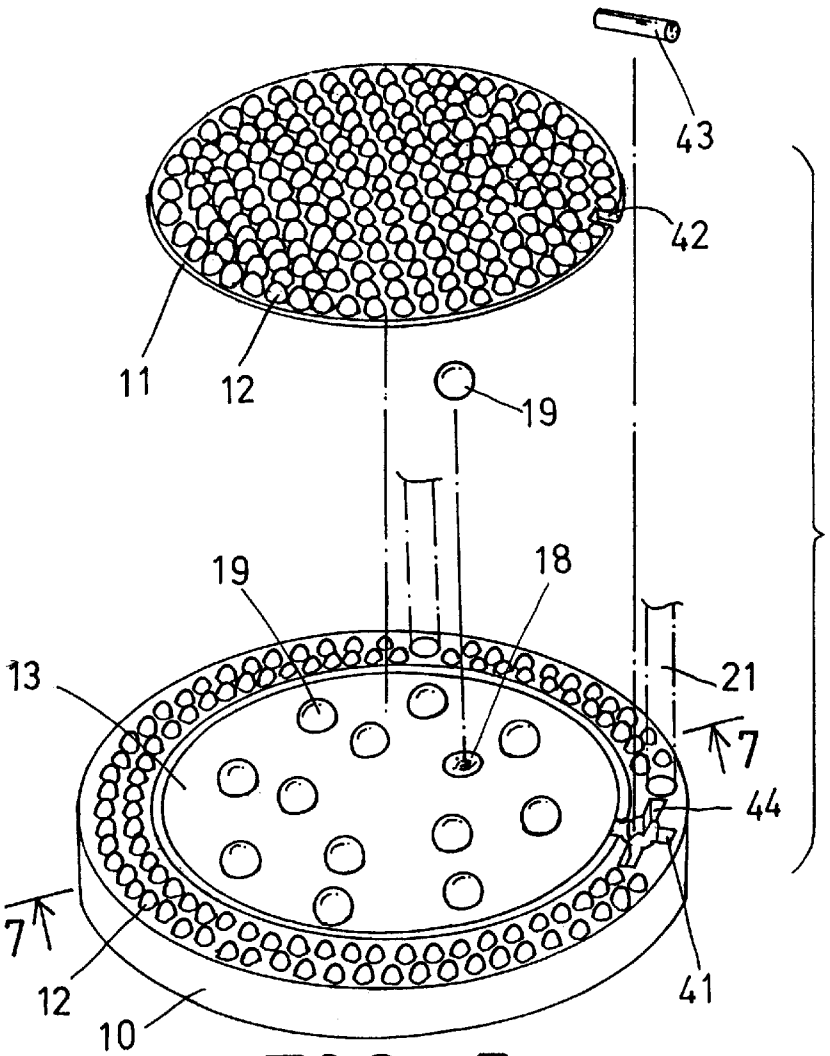
FIG. 5 is a partial exploded view of a base of the massage device.
Figure 6:
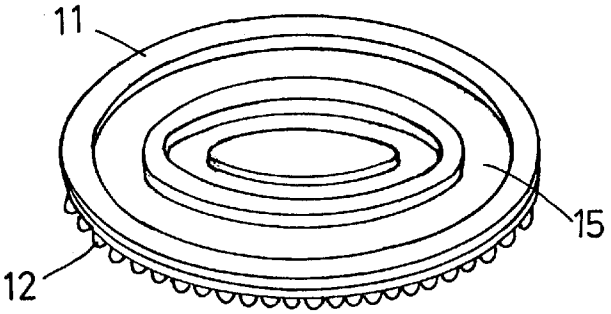
FIG. 6 is a bottom perspective view illustrating the base of the massage device.
Figure 7:
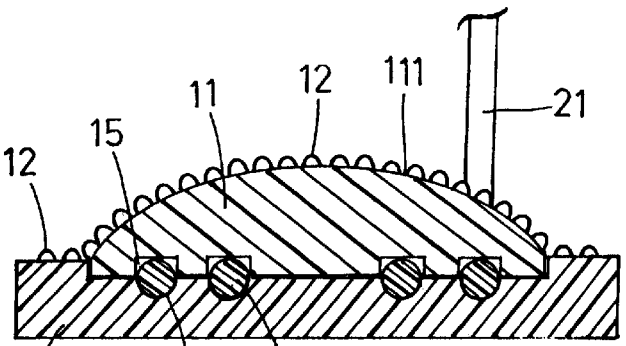
FIG. 7 is a cross sectional view taken along lines 7—7 of FIG. 1. the folding or storing configuration of the massage device.

The handle 30 is secured on top of the support 20 with fasteners or the like, and includes a depression 31 formed therein for receiving a timer, an electric facility 40 or the like therein, which may be used for recording or playing a phrase or a word or a sentence or the like, and/or which may tell the time or the weight etc., for the users. As shown in FIG. 4, the base 10 includes a bottom portion having an opening 14 and one or more recesses 16, 17 formed therein. The supports 20 and the handle 30 may be detached or disengaged from the base 10 and may then be received and stored in the recesses 16, 17 of the base 10 in the folded or storing position, such that the massage device may include a greatly decreased volume that is good for transportation and storing purposes. The provision of the opening 14 in the base 10 allows the supports 20 and the handle 30 to be easily received and stored in the recesses 16, 17 of the base 10.

It is to be noted that the upwardly extended and rounded projections 12 on the upwardly curved bulge 111 and/or on the base 10 may be used for effectively engaging with the feet of the users and may thus be used for effectively massaging the feet of the users. The base 10 includes a circular peripheral portion having a size or an outer diameter for allowing the users to step on the base 10 and to conduct both exercise and massage purposes. In operation, the users may step on the rotary member and to twist and exercise their waist portions. The users may hold the handle 30 to support the upper portion of the users and to adjust the reactive force of the massage projections 12 against the feet of the users.

Referring again to FIGS. 1 and 5, the base 10 includes a lock slot 41 formed in the outer peripheral portion thereof, the rotary member 11 includes a lock notch 42 formed therein for selectively aligning with the lock slot 41 of the base 10 (FIG. 1) and for selectively receiving a latch 43 which may latch or lock the rotary member 11 to the base 10 and which may prevent the rotary member 11 from rotating relative to the base 10. The base 10 further includes a storing slot 44 formed therein and preferably perpendicular to the lock slot 41 of the base 10 for receiving and storing the latch 43 when the latch 43 is disengaged from the rotary member 11. In operation, the latch 43 may be used to selectively lock the rotary member 11 to the base 10 by the users.

Accordingly, the massage device in accordance with the present invention includes an upwardly curved upper surface having a number of massage projections extended upward therefrom for massaging purposes, and includes a handle provided above the base for supporting the upper portion of the users. The users may step on the rotary member and to twist and exercise their waist portions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A massage device for massaging feet of user, said massage device comprising:

a base including an upper portion, said base including an outer peripheral portion having a plurality of massage projections extended upward therefrom for engaging with and for massaging the feet of the user, a rotary member rotatably supported on said upper portion of said base and including an upper portion having a plurality of massage projections extended upward therefrom for engaging with and for massaging the feet of the user, and a handle supported above said base for supporting an upper portion of the user.

2. The massage device according to claim 1, wherein said rotary member includes an upwardly curved upper surface provided on said upper portion thereof and having said massage projections extended upward therefrom for engaging with and for massaging the feet of the user.

3. The massage device according to claim 1 further comprising means for locking said rotary member to said base.

4. The massage device according to claim 3, wherein said lock means includes a latch selectively engaged with said base and said rotary member for selectively locking said rotary member to said base.

5. The massage device according to claim 1 further comprising means for rotatably supporting said rotary member on said base.

6. The massage device according to claim 1 further comprising means for supporting said handle above said base.

7. The massage device according to claim 6, wherein said supporting means includes at least one tube secured on said base, a rod slidably engaged in said tube, and means for adjustably securing said rod to said tube.

8. The massage device according to claim 6, wherein said base includes at least one recess formed therein for receiving said at least one tube and said rod.

9. The massage device according to claim 6, wherein said base includes at least one recess formed therein for receiving said handle.

10. A massage device for massaging feet of user, said massage device comprising:

a base including an upper portion, a rotary member rotatably supported on said upper portion of said base and including an upper portion having a plurality of massage projections extended upward therefrom for engaging with and for massaging the feet of the user, a handle supported above said base for supporting an upper portion of the user, and means for locking said rotary member to said base, said lock means including a latch selectively engaged with said base and said rotary member for selectively locking said rotary member to said base, and said base including a lock slot formed therein for selectively receiving said latch, and said rotary member including a lock notch formed therein for selectively receiving said latch.

11. The massage device according to claim 10, wherein said base includes a storing slot formed therein and communicating with said lock slot of said base for selectively receiving said latch.

12. A massage device for massaging feet of user, said massage device comprising:

a base including an upper portion, a rotary member rotatably supported on said upper portion of said base and including an upper portion having a plurality of massage projections extended upward therefrom for engaging with and for massaging the feet of the user, a handle supported above said base for supporting an upper portion of the user, and means for locking said rotary member to said base, said lock means including a latch selectively engaged with said base and said rotary member for selectively locking said rotary member to said base, and said base including a storing slot formed therein for selectively receiving said latch.

13. A massage device for massaging feet of user, said massage device comprising:

a base including an upper portion, a rotary member rotatably supported on said upper portion of said base and including an upper portion having a plurality of massage projections extended upward therefrom for engaging with and for massaging the feet of the user, a handle supported above said base for supporting an upper portion of the user, and means for rotatably supporting said rotary member on said base, said rotatably supporting means including at least one ball engaged between said base and said rotary member.

14. The massage device according to claim 13, wherein said base includes at least one cavity formed therein for rotatably receiving said at least one ball.

15. The massage device according to claim 13, wherein said rotary member includes a bottom portion having at least one circular groove formed therein for receiving said at least one ball.

* * * * *